US009995022B2

(12) United States Patent
Hooijmans

(10) Patent No.: US 9,995,022 B2
(45) Date of Patent: Jun. 12, 2018

(54) WING SHROUD FOR A DRAGLINE LIP

(71) Applicant: Caterpillar Work Tools B.V., s-Hertogenbosch (NL)

(72) Inventor: Willem J. Hooijmans, Kerkdriel (NL)

(73) Assignee: Caterpillar Work Tools B.V., s-Hertogenbosch (NL)

( * ) Notice: Subject to any disclaimer, the term of this patent is extended or adjusted under 35 U.S.C. 154(b) by 0 days. days.

(21) Appl. No.: 15/121,583

(22) PCT Filed: Feb. 26, 2015

(86) PCT No.: PCT/EP2015/054095

§ 371 (c)(1),
(2) Date: Aug. 25, 2016

(87) PCT Pub. No.: WO2015/128441

PCT Pub. Date: Sep. 3, 2015

(65) Prior Publication Data

US 2016/0362874 A1 Dec. 15, 2016

(30) Foreign Application Priority Data

Feb. 28, 2014 (EP) ..... 14157320

(51) Int. Cl.
*E02F 9/28* (2006.01)
*E02F 3/60* (2006.01)
*E02F 3/48* (2006.01)

(52) U.S. Cl.
CPC ..... *E02F 9/2883* (2013.01); *E02F 3/48* (2013.01); *E02F 3/60* (2013.01); *E02F 9/2858* (2013.01)

(58) Field of Classification Search
CPC ..... A01B 15/025; E02F 3/8152; E02F 3/40; E02F 9/28; E02F 9/2816; E02F 9/2858;
(Continued)

(56) References Cited

U.S. PATENT DOCUMENTS 3,812,608 A * 5/1974 Ratkowski ..... E02F 9/2858 37/448
3,961,788 A * 6/1976 Helton ..... E02F 3/8152 172/701.2

(Continued)

FOREIGN PATENT DOCUMENTS

| | | |
|---|---|---|
| GB | 2272008 | 5/1994 |
| WO | WO 2011/075782 | 6/2011 |
| WO | WO 2013/067585 | 5/2013 |

OTHER PUBLICATIONS

European Search Report dated May 12, 2014.
International Search Report dated Apr. 23, 2015.

*Primary Examiner* — Robert E Pezzuto

(57) ABSTRACT

A dragline lip assembly comprising, a dragline lip including at least one upright member having a boss, and a wing shroud comprising. The wing shroud further comprising a first sidewall having a first abutment surface, a second sidewall having a second abutment surface wherein the second sidewall has a securing portion configured so as to be coupled to a lock assembly on the dragline lip, and a center wall having a third abutment surface provided with an opening, the center wall connecting the first sidewall and the second sidewall wherein the first, second and third abutment surfaces define a channel to receive a portion of the at least one upright member and wherein the boss is insertable in the opening.

12 Claims, 6 Drawing Sheets

(58) Field of Classification Search
CPC ..... E02F 9/2883; E02F 9/2833; E02F 3/48; E02F 3/60
USPC ..... 37/446, 448, 449; 172/701.1–701.3, 719, 172/772, 810; 414/722–726
See application file for complete search history.

(56) References Cited

U.S. PATENT DOCUMENTS

| | | | | |
|---|---|---|---|---|
| 5,088,214 | A | 2/1992 | Jones | |
| 5,333,696 | A * | 8/1994 | Cornelius | A01B 15/025 172/719 |
| 5,526,592 | A | 6/1996 | Bierwith | |
| 5,553,409 | A | 9/1996 | Irving | |
| 7,596,895 | B2 | 10/2009 | Jones | |
| 8,024,874 | B2 | 9/2011 | McClanahan et al. | |
| 9,091,042 | B2 * | 7/2015 | Guimaraes | E02F 9/2833 |
| 9,593,470 | B2 * | 3/2017 | Dallard | E02F 3/40 |
| 2004/0098886 | A1 | 5/2004 | Hohmann et al. | |
| 2013/0185965 | A1 | 7/2013 | Bartolome Rodriguez | |
| 2013/0247427 | A1 | 9/2013 | Campomanes | |

* cited by examiner

WING SHROUD FOR A DRAGLINE LIP

CLAIM FOR PRIORITY

This application is a U.S. National Phase entry under 35 U.S.C. § 371 from PCT International Application No. PCT/EP2015/054095, filed Feb. 26, 2015, which claims benefit of priority of European Patent Application No. 14157320.4, filed Feb. 28, 2014, all of which are incorporated herein by reference.

TECHNICAL FIELD

This disclosure relates to the field of replaceable wear parts, in particular to a replaceable wear part for protection of a leading edge of an earthmoving implement such as a drag line bucket, a face shovel, buckets for front-end loaders, excavators and the like.

BACKGROUND

Mining and earthmoving operations require a ground engaging implement that may be generally provided on a vehicle. The ground engaging implement may be a bucket such as a dragline bucket or an excavator bucket. The leading edges of the bucket may be subjected to wear during the mining and earthmoving operations. The leading edges may include the digging edge and structural elements that support the digging edge. In order to protect these leading edges from wear a wear member may be used.

The wear members may be bolted to the leading edges such as the portions between the respective tip assemblies on the digging edge and the structural elements supporting the digging edge. In other applications, the wear members may be fastened to the individual tip assemblies by various forms of fasteners or mechanical interlock systems.

The wear members may be welded to leading edges of the bucket to increase the usable life of the implement. The wear members may operate in harsh working conditions and may be subjected to heavy loading and a high degree of wear so as to protect the leading edges from premature wear. Accordingly, the wear members may wear out frequently and require periodic replacement.

Hence, there is a need to be able to quickly and easily remove a worn wear member and to replace it. However, wear members that are welded to the leading edges may require substantial dismantling of the bucket for their removal. Further complications may arise when mechanical fastening methods, such as bolts or pins, are used to attach the wear members. The mechanical fasteners are required to withstand large forces that may arise during the mining and earth moving operations. These forces may result in deformation of the mechanical fastener, thereby rendering the removal of the wear members more difficult.

Thus, a quick and easy removal of the wear members is required while ensuring that the wear members are securely mounted in a manner to withstand the considerable forces exerted thereon during operation.

WO2013067585 discloses a wear member in the form of a wing shroud. The wing shroud may be mountable to an excavator bucket. In particular, the wing shroud may be mountable on one or more adaptors in the form of mounting projections that extend from and may be integral with the excavator bucket.

The present disclosure is directed, at least in part, to improving or overcoming one or more aspects of the prior art system.

BRIEF SUMMARY OF THE INVENTION

In a first aspect, the present disclosure describes a wing shroud for a dragline lip, the wing shroud comprising: a first sidewall having a first abutment surface; a second sidewall having a second abutment surface wherein the second sidewall has a securing portion configured for coupling to a lock device on the dragline lip; a centre wall having a third abutment surface provided with an opening, the centre wall connecting the first sidewall and the second sidewall wherein the first, second and third abutment surfaces define a channel to receive an upright portion of the dragline lip.

In a second aspect, the present disclosure describes a dragline lip assembly comprising: a dragline lip comprising at least one upright member having a boss; and a wing shroud which comprises: a first sidewall having a first abutment surface; a second sidewall having a second abutment surface wherein the second sidewall has a securing portion configured so as to be coupled to a lock device on the dragline lip; a centre wall having a third abutment surface provided with an opening, the centre wall connecting the first sidewall and the second sidewall wherein the first, second and third abutment surfaces define a channel to receive a portion of the at least one upright member and wherein the boss is insertable in the opening.

BRIEF DESCRIPTION OF THE DRAWINGS

The foregoing and other features and advantages of the present disclosure will be more fully understood from the following description of various embodiments, when read together with the accompanying drawings, in which.

DETAILED DESCRIPTION

This disclosure generally relates to a wing shroud for assembly onto a ground engaging implement. The wing shroud may be used to protect a leading edge of the ground engaging implement from wear. In an embodiment, the ground engaging implement may be a dragline bucket, a hydraulic excavator, a mining shovel or a electric rope shovel.

Figure 1:
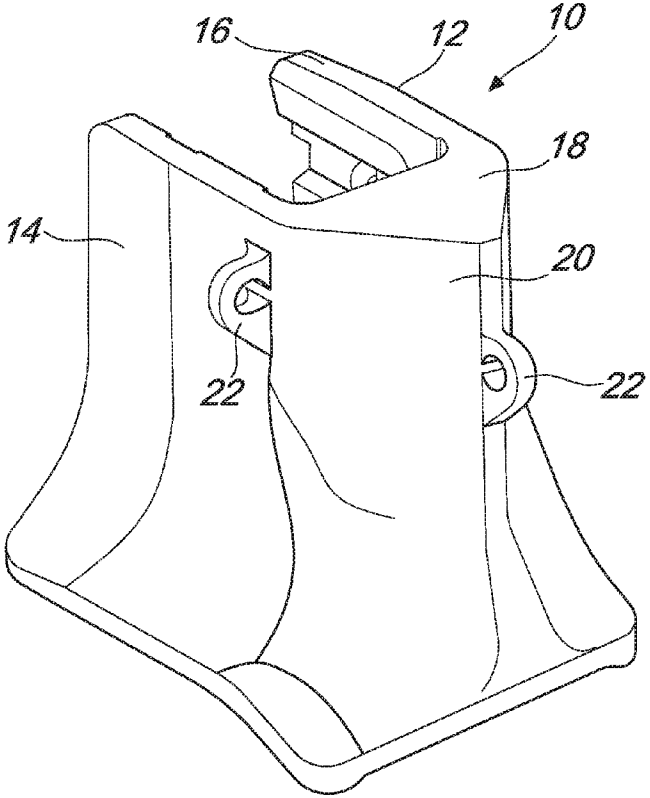
FIG. 1 is a first isometric view of a wing shroud according to the present disclosure.

FIG. 1 illustrates a wing shroud 10 for mounting to a dragline lip (not shown). The wing shroud 10 may comprise a first sidewall 14, a second sidewall 16 and a centre wall 18. The first sidewall 14, second sidewall 16 and centre wall 18 may be formed as a monolithic body 12. In an embodiment, first sidewall 14, second sidewall 16 and centre wall 18 may be separately formed structures that are joined together to form the body 12.

Wing shroud 10 may comprise a wear surface 20 that extends along the surfaces of the first sidewall 14, the second sidewall 16 and the centre wall 18. Wear surface 20 may be the outer surface of body 12 that contacts the material during work operations. One or more hoist loops 22 may be positioned on the wear surface 20 to enable ease of handling by a hoist during attachment and removal operations of the wing shroud 10.

Figure 2:
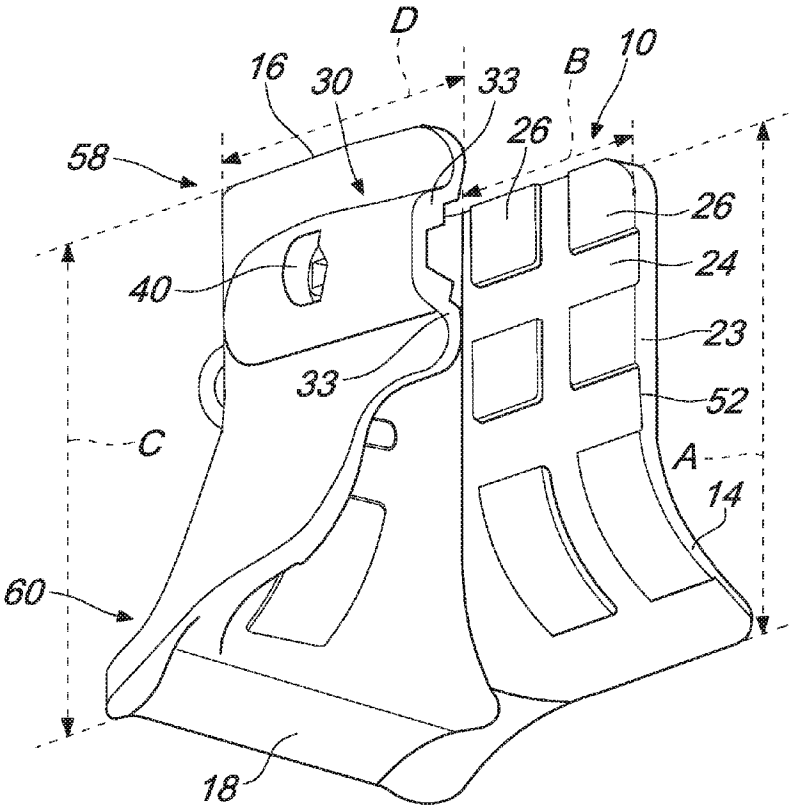
FIG. 2 is a second isometric view of the wing shroud according to the present disclosure.

With reference to FIG. 2, the first sidewall 14 may have a first abutment surface 24 of the wing shroud 10. First abutment surface 24 may abut a portion of the dragline lip (not shown). First abutment surface 24 may be on the side of the first sidewall 14 opposite to the side with the wear surface 20. First abutment surface 24 may have at least one raised contact portion 26. Raised contact portion 26 may be contiguous with a first free edge 23 of the wing shroud 10. The raised contact portion 26 may be a quadrilateral. The raised contact portion 26 may have a squarish cross section. In an alternate embodiment, the raised contact portion 26 may be circular.

Raised contact portion 26 may eliminate the need for full surface contact between the first sidewall 14 and the dragline lip. Full contact surfaces may require closer manufacturing tolerances. The raised contact portion 26 may enable easier working during servicing instead of a full contact surfaces.

In a further embodiment, first abutment surface 24 may have a plurality of raised contact portions 26. The raised contact portions 26 may be positioned in an arrangement. The raised contact portions 26 may be arranged in a single row or in a plurality of rows. The plurality of rows may be parallel. Raised contact portions 26 may be arranged in a staggered arrangement.

In yet a further embodiment, first abutment surface 24 may have a plurality of indentations positioned in an arrangement. The indentations may be arranged in a single row or in a plurality of rows along a longitudinal axis of the first sidewall 14. The plurality of rows may be parallel. Indentations may be arranged in a staggered arrangement.

First sidewall 14 may have a plate-like structure. First sidewall 14 may have a length A ranging from 452 mm to 472 mm. First sidewall 14 may have a length A of 462 mm. First sidewall 14 may have a width B ranging from 290 mm to 310 mm. First sidewall 14 may have a width B of 300 mm. First sidewall 14 may have an end that is curved. The angle of curvature may range between 100 degrees to 110 degrees. The angle of curvature may be 105 degrees. The curved end may follow the curvature of the dragline lip so as to protect that portion of the dragline lip.

Raised contact portions 26 at the curved end may have dimensions greater than the raised contact portions 26 spaced from the curved end. Raised contact portions 26 at the curved end may be rectangular in shape.

Figure 3:
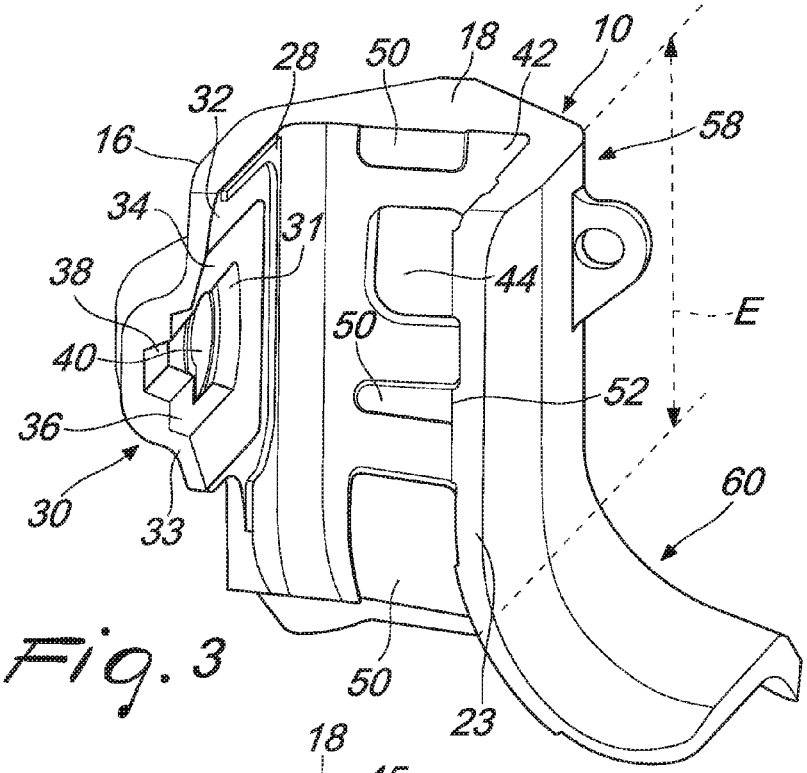
FIG. 3 is a third isometric view of the wing shroud according to the present disclosure.

With reference to FIG. 3, the second sidewall 16 may have a second abutment surface 32 of the wing shroud 10. Second abutment surface 32 may be on the side of the second sidewall 16 opposite to the side with the wear surface 20. Second abutment surface 32 may abut a portion of the dragline lip (not shown).

Second abutment surface 32 may have at least one elevated contact portion 28. Elevated contact portion 28 may be provided on the second abutment surface 32 opposite to a second free edge 33 of the wing shroud 10. The elevated contact portion 28 may extend across the second abutment surface 32 along the edge opposite the second free edge 33.

The second sidewall 16 may have a securing portion 30 configured for coupling to a lock device (not shown) that is positioned on the dragline lip. Securing portion 30 may be recessed into the second abutment surface 32. Securing portion 30 may be extended in a direction normal to the longitudinal axis of the second sidewall 16. Securing portion 30 may be truncated at the second free edge 33. Securing portion 30 may be enclosed by the elevated contact portion 28 along three sides of the securing portion 30 that are adjacent to the second free edge 33.

Securing portion 30 may be configured to have a centrally located void 31. Void 31 may be extended in a direction transverse to the longitudinal axis of the second sidewall 16 and direction of extension of the securing portion 30. Void 31 may extend to second free edge 33 of the wing shroud 10. Void 31 may be accessed through the second sidewall 16 and through an aperture 40 provided in the securing portion 30. The aperture 40 may be located opposite the second sidewall 16. Aperture 40 may be parallel to the second sidewall 16. A plane transversally intersecting the aperture 40 may be parallel to the second sidewall 16. Aperture 40 may be parallel to the second abutment surface 32. A plane transversally intersecting the aperture 40 may be parallel to the abutment surface 32.

Securing portion 30 may comprise an inclined wall 34 extending inwards from the second abutment surface 32. Inclined wall 34 may project in a direction substantially away from the second abutment surface 32. Inclined wall 34 may form a three sided border around a portion of void 31 that is contiguous with the border formed by the second abutment surface 32.

Securing portion 30 may comprise a first stepped portion 36 joined to the inclined wall 34 along an edge opposite to the edge joined to the second abutment surface 32. A second stepped portion 38 may be joined to the first stepped portion 36. The first and second stepped portions 36, 38 may form a three sided border around a portion of void 31 that is contiguous with the border formed by the inclined wall 34. The second stepped portion 38 may connect two opposite sides of the first stepped portion 36. Second stepped portion 38 may form a ceiling over a portion of the void 31.

With reference to FIG. 2, second sidewall 16 may have a plate-like structure that is provided with a protuberance in the form of the securing portion 30. Second sidewall 16 may have a length C ranging from 424 mm to 444 mm. Second sidewall 16 may have a length C of 434 mm. Second sidewall 16 may a width D ranging from 290 mm to 310 mm. Second sidewall 16 may have a width D of 300 mm. In an embodiment, second sidewall 16 may have an end that is curved.

With reference to FIG. 3, the centre wall 18 may have a third abutment surface 42 of the wing shroud 10. Third abutment surface 42 may be on the side of the centre wall 18 opposite to the side with the wear surface 20. Third abutment surface 42 may abut a portion of the dragline lip (not shown).

Figure 4:
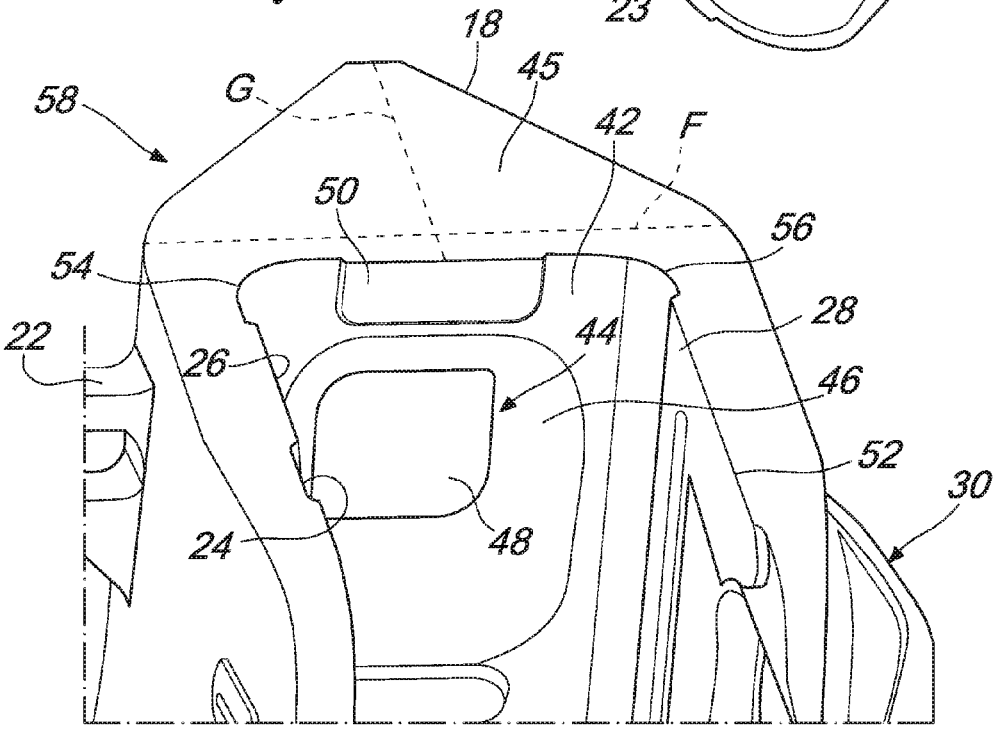
FIG. 4 is a fourth isometric view of the wing shroud according to the present disclosure.

With reference to FIG. 4, third abutment surface 42 may be provided with an opening 44. Opening 44 may be quadrangular in shape. Opening 44 may have sides 46 that are orthogonal to the third abutment surface 42. Opening 44 may have a floor 48 parallel to the third abutment surface 42. Opening 44 may have a length ranging from 90 mm to 94 mm, a width ranging from 80 mm to 84 mm and a depth ranging from 63 mm to 67 mm. Opening 44 may have a length of 92 mm, a width of 82 mm and a depth 65 mm. Opening 44 may be centrally aligned on the third abutment surface 42. Opening 44 may be centrally aligned on the third abutment surface 42 with respect to the sides of the centre wall 18.

In an embodiment, opening 44 may be positioned at the same height as at least one hoist loop 22 with reference to a first end 58 of the wing shroud 10. In another embodiment, the opening 44 may be formed in a suitable shape and may have suitable dimensions to receive a boss (not shown) provided on the dragline lip (not shown). In yet another embodiment, third abutment surface 42 may have a plurality of reliefs 50 positioned thereon. Reliefs 50 may eliminate the need for full surface contact between the centre wall 18 and the dragline lip. Full contact surfaces may require closer manufacturing tolerances. The reliefs 50 may enable easier working during servicing instead of a full contact surfaces.

The reliefs 50 may be axially positioned on the third abutment surface 42. The reliefs 50 may be axially spaced from the opening 44. The reliefs 50 may be longitudinally aligned with the opening 44. In yet a further embodiment, the opening 44 may be a through opening so as to extend through the centre wall 18 and to be accessible through both the third abutment surface 42 and the wear surface 20.

With reference to FIG. 3, centre wall 18 may have a cross section of a truncated triangle. Centre wall 18 may have a length E ranging from 244 mm to 264 mm. Centre wall 18 may have a length E of 254 mm. With reference to FIG. 4, centre wall 18 may have a width F of 247 mm to 267 mm. Centre wall 18 may have a width F ranging from 257 mm. Centre wall 18 may have a height G ranging from 160 mm to 180 mm. Centre wall 18 may have a height G of 170 mm. Centre wall 18 may have an end that is curved.

With respect to FIGS. 2 to 4, the centre wall 18 may connect the first sidewall 14 and the second sidewall 16. The first, second and third abutment surfaces 24, 32, 42 may define a channel 52. Channel 52 may be formed interiorly relative to the external wear surface 20. Channel 52 may be configured to receive a structural element of the dragline lip. The channel 52 may have a substantially U shaped cross section. Channel 52 may have a width ranging from 174 mm to 184 mm between the first and second abutment surfaces 24, 32. Channel 52 may have a width of 179 mm. Channel 52 may have a height ranging from 295 mm to 305 mm from the third abutment surface 42 along the first and second abutment surfaces 24, 32. Channel 52 may have a width of 179 mm. Channel 52 may have a height of 300 mm.

With reference to FIG. 4, the first and third abutment surfaces 24, 42 may be separated by a first groove 54. The second and third abutment surface 32, 42 may be separated by a second groove 56. In an embodiment, the first, second and third abutment surfaces 24, 32, 42 may be joined to form a continuous abutment surface.

With reference to FIGS. 3 and 4, the first sidewall 14 may be substantially parallel to the second sidewall 16. The first abutment surface 24 may be substantially parallel to the second abutment surface 32. The raised contact portion 26 may have a surface that is substantially parallel to the second abutment surface 32. In an embodiment, the plurality of raised contact portions 26 may have surfaces that are substantially parallel to the second abutment surface 32.

The void 31 may be recessed in a direction substantially normal to the first abutment surface 24. The void 31 may be recessed in a direction substantially normal to the surface of the at least one raised contact portion 26 or the surfaces of the plurality of raised contact portions 26. Aperture 40 may be substantially parallel to the first abutment surface 24. Aperture 40 may be substantially parallel to the surface of the at least one raised contact portion 26 or the surfaces of the plurality of raised contact portions 26.

The centre wall 18 may be substantially orthogonal to the first sidewall 14. The first abutment surface 24 may be substantially orthogonal to the third abutment surface 42. The raised contact portion 26 may have a surface that is substantially orthogonal to the third abutment surface 42. In an embodiment, the plurality of raised contact portions 26 may have surfaces that are substantially orthogonal to the third abutment surface 42.

Opening 44 may be positioned approximately 47.5 mm to 49.5 mm from the first sidewall 14. Opening 44 may be positioned approximately 48.5 mm from the first sidewall 14. Opening 44 may be substantially orthogonal to the first sidewall 14. Opening 44 may be substantially orthogonal to the first abutment surface 24. A plane transversally intersecting the opening 44 may be substantially orthogonal to the first abutment surface 24. Opening 44 may be substantially orthogonal to the surface of the at least one raised contact portion 26 or the surfaces of the plurality of raised contact portions 26. A plane transversally intersecting the opening 44 may be substantially orthogonal to the surface of the at least one raised contact portion 26 or the surfaces of the plurality of raised contact portions 26.

At least one side 46 of the opening 44 may be substantially parallel to the first side wall 14. At least one side 46 of the opening 44 may be substantially parallel to the first abutment surface 24. At least one side 46 of the opening 44 may be substantially parallel to the surface of the at least one raised contact portion 26 or the surfaces of the plurality of raised contact portions 26. The at least one side 46 may be the side proximate to the first sidewall 14.

In an embodiment, the at least one side 46 distal to the first sidewall 14 may be substantially parallel thereto. In a further embodiment, the side 46 distal to the first sidewall 14 and the side 46 proximate to the first side wall 14 may both be substantially parallel to the first side wall 14 and/or the first abutment surface 24. In yet a further embodiment, the side 46 distal to the first sidewall 14 and the side 46 proximate to the first side wall 14 may both be substantially parallel to the surface of the at least one raised contact portion 26 or the surfaces of the plurality of raised contact portions 26.

The centre wall 18 may be substantially orthogonal to the second sidewall 16. The second abutment surface 32 may be substantially orthogonal to the third abutment surface 42. Opening 44 may be positioned approximately 47.5 mm to 49.5 mm from the second sidewall 16. Opening 44 may be positioned approximately 48.5 mm from the second sidewall 16.

Opening 44 may be substantially orthogonal to the second sidewall 16. Opening 44 may be substantially orthogonal to the second abutment surface 32. A plane transversally intersecting the opening 44 may be substantially orthogonal to the second abutment surface 32.

The void 31 may be recessed in a direction substantially parallel to the centre wall 18. Void 31 may be recessed in a direction substantially parallel to the third abutment surface 42. Void 31 may be recessed in a direction substantially parallel to the opening 44. Void 31 may be recessed in a direction substantially parallel to a plane transversally intersecting the opening 44.

Aperture 40 may be substantially normal to the centre wall 18. Aperture 40 may be substantially normal to the third abutment surface 42. Aperture 40 may be substantially normal to the opening 44. A plane transversally intersecting the aperture 40 may be substantially normal to the plane transversally intersecting the opening.

At least one side 46 of the opening 44 may be substantially parallel to the second side wall 16. At least one side 46 of the opening 44 may be substantially parallel to the second abutment surface 32. At least one side 46 of the opening 44 may be substantially parallel to the aperture 40. At least one side 46 of the opening 44 may be substantially normal to the direction of extension of the void 31. The at least one side 46 may be the side proximate to the second sidewall 16.

In an embodiment, the side 46 distal to the second sidewall 16 may be substantially parallel thereto. In a further embodiment, the side 46 proximate to the second sidewall 16 and the side 46 distal to the second sidewall 16 may both be parallel to the second sidewall 16 and/or the second abutment surface 32.

With reference to FIG. 3, wing shroud 10 may comprising the first end 58 and a second end 60. With reference to FIGS. 2 and 3, the second end 60 may be flared outwardly relative to the channel 52. The dimension of channel 52 at the second end 60 may have a greater dimension relative to the first end 58.

With reference to FIG. 4, the opening 44 may be adjacent the first end 58. A side 46 of the opening 44 adjacent to the first end 58 may be positioned between 64 mm to 74 mm from a free surface 45 of the first end 58. The side 46 of the opening 44 adjacent to the first end 58 may be positioned 69 mm from the free surface 45. The side 46 may be parallel to the free surface 45.

Figure 5:
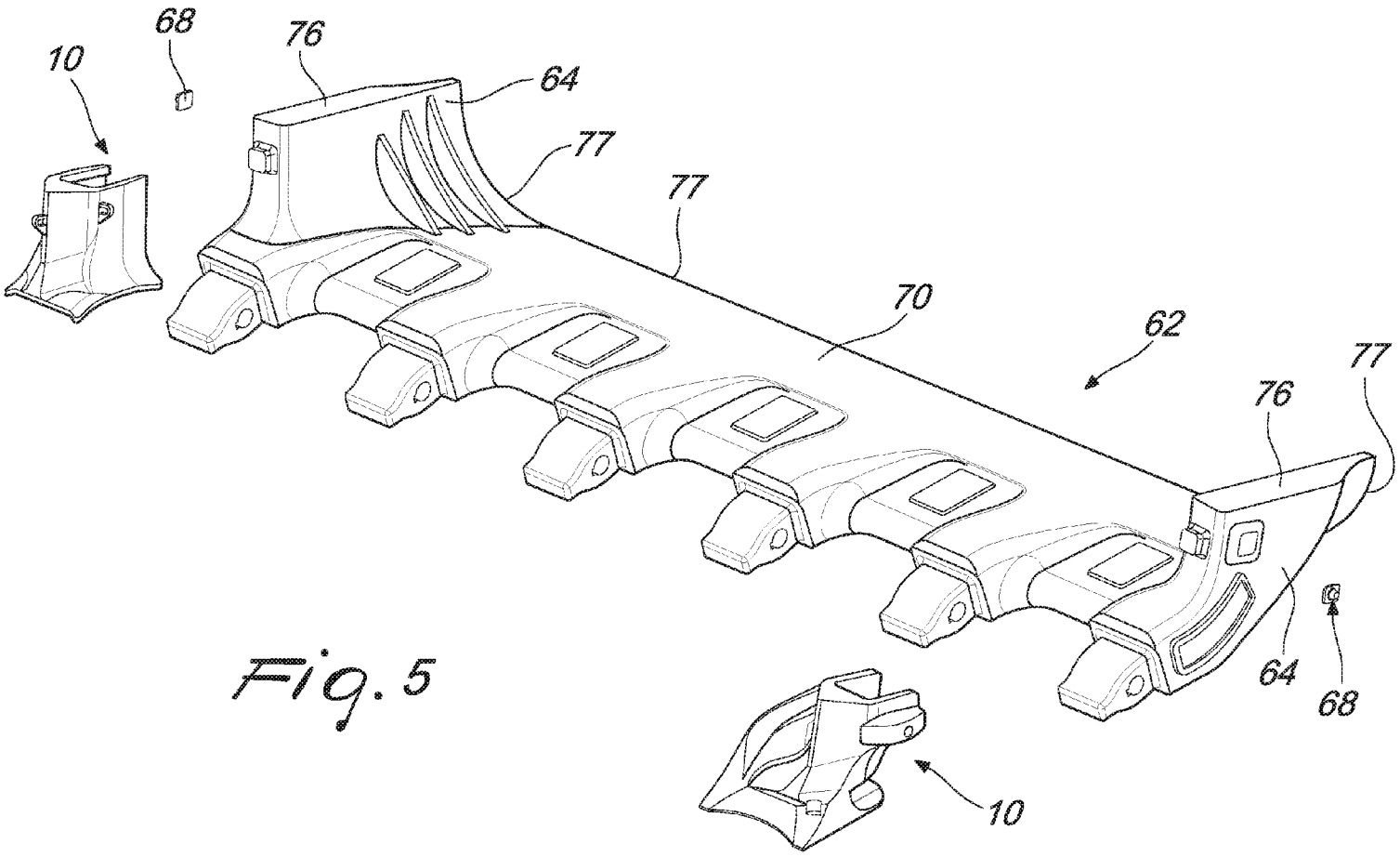
FIG. 5 is an exploded view of the wing shrouds of FIG. 1 and a bucket lip.

FIG. 5 illustrates a dragline lip 62 for a dragline bucket. The dragline lip 62 may be a cast dragline lip 62. Dragline lip 62 may present the leading edge of the dragline bucket and may be subject to wear during mining and earthmoving operations. Dragline lip 62 may have structural elements in the form of upright member 64 and a lip member 70. Upright members 64 may project from the lip member 70 inclined away from the centre of the lip member 70. Each upright member 64 may be inclined at an angle of 4 degrees to 6 degrees from the lip member 70. Each upright member 64 may be inclined at an angle of 5 degrees from the lip member 70. In an embodiment, upright members 64 may project orthogonally from the lip member 70.

The dragline lip 62 may be a monolithic structure. The upright members 64 may be located at opposite ends of the lip member 70 and may be mirror opposites. Upright members 64 may have coupling ends 76 for connection to the respective parts of the dragline bucket. Lock assemblies 68 may be mounted to mounting portions on the upright members 64. A coupling surface 77 may extend between the upright members 64 across the lip member 70. The coupling surface 77 may be formed on the side opposite the side receiving the wing shrouds 10. The coupling ends 76 and the coupling surface 77 may be welded to the dragline bucket (not shown).

Wing shrouds 10 may be mountable at the respective upright members 64 for protection from wear. The wing shrouds 10 for mounting to the respective upright members 64 may be mirror opposites. Wings shrouds 10 may have a suitable dimension to fit onto the respective upright members 64.

Figure 6:
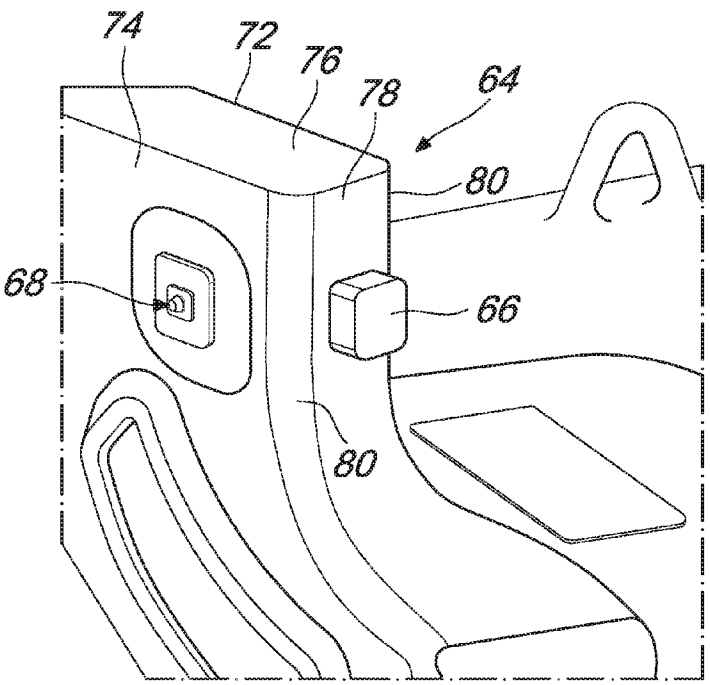
FIG. 6 is an isometric view of a structural element of a bucket lip available for mounting of the wing shroud of FIG. 1.

FIG. 6 illustrates a part of the upright member 64. The upright member 64 may be provided with a boss 66. The boss 66 may be quadrangular in shape. Boss 66 may have a length ranging from 89 mm to 93 mm, a width of ranging from 79 mm to 83 mm and a depth ranging from 62 mm to 66 mm. Boss 66 may have a length of 90 mm, a width of 80 mm and a height of 60 mm.

In an embodiment, boss 66 may be suitably shaped and may have a suitable dimension to be inserted into the opening 44 of the wing shroud 10. The boss 66 may be positioned adjacent the coupling end 76. The end opposite the coupling end 76 may be outwardly flared.

Upright member 64 may be provided with a lock assemblies 68 for coupling to the securing portion 30 on the wing shroud 10. The coupling of the lock assemblies 68 to the securing portion 30 enables the wing shroud to be maintained on the upright member 64. In an embodiment, the lock assembly 68 may be positioned at substantially the same height as the boss 66 with reference from the coupling end 76.

Figure 7:
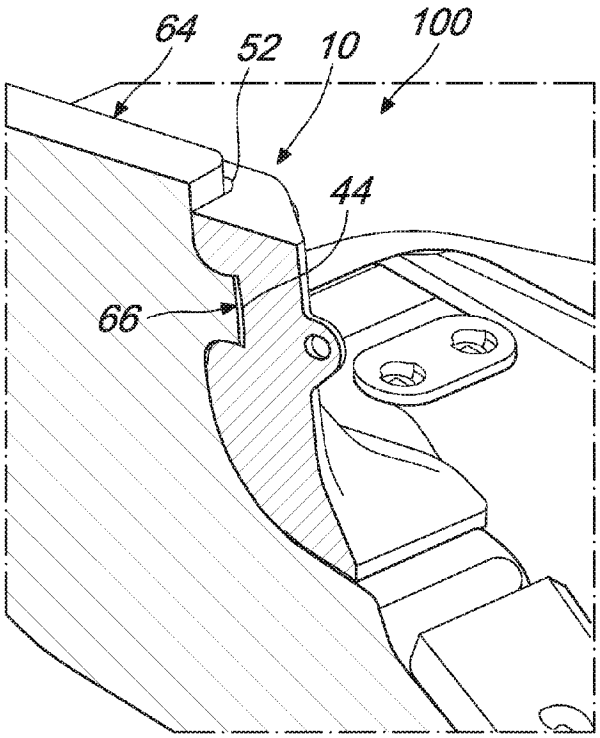
FIG. 7 is a cross sectional view of the wing shroud of FIG. 1 mounted on the structural element of FIG. 6.

FIG. 7 illustrates a cross section of a dragline lip assembly 100 with a wing shroud 10 mounted on a respective upright member 64. The dragline lip assembly 100 may comprise the dragline lip 62 comprising at least one upright member 64 having a boss 66 and a wing shroud 10. The wing shroud 10 may comprise a first sidewall 14 having a first abutment surface 24; a second sidewall 16 having a second abutment surface 32 wherein the second sidewall 16 has a securing portion 30 configured so as to be coupled to a lock assemblies 68 on the dragline lip 62; a centre wall 18 having a third abutment surface 42 provided with an opening 44, the centre wall 18 connecting the first sidewall 14 and the second sidewall 16 wherein the first, second and third abutment surfaces 24, 32, 42 define a channel 52 to receive a portion of the at least one upright member 64 and wherein the boss 66 is insertable in the opening 44.

With reference to FIG. 6, the upright member 64 may comprise a first contact surface 72 and a second contact surface 74. The second contact surface 74 may have the lock assembly 68. The first and second contact surfaces 72, 74 may be substantially parallel. The upright member 64 may further comprise a third contact surface 78. Third contact surface 78 may be substantially normal to the first contact surface 72. Third contact surface 78 may be substantially normal to the second contact surface 74.

Third contact surface 78 may connect the first contact surface 72 to the second contact surface 74. First, second and third contact surfaces 72, 74, 78 may abut respective first, second and third abutment surfaces 24, 32, 42 of the wing shroud 10. First, second and third contact surfaces 72, 74, 78 may abut respective raised contact portion 26, elevated contact portion 28 and relief 50. First, second and third contact surfaces 72, 74, 78 may fit in the channel 52. In an embodiment, third contact surface 78 may connect to the first contact surface 72 and to the second contact surface 74 by curved sections 80. Curved sections 80 may fit into respective first and second grooves 54, 56.

The boss 66 may be provided on the third contact surface 78. The boss 66 may be centrally aligned on the third contact surface 78 relative to the first and second contact surfaces 72, 74. The boss 66 may extend from the third contact surface 78 in a direction parallel to the first contact surface 72. A plane transversally intersecting the boss 66 may be substantially normal to the first contact surface 72. The boss 66 may extend from the third contact surface 78 in a direction parallel to the second contact surface 74. A plane transversally intersecting the boss 66 may be substantially normal to the second contact surface 74.

A side of the boss 66 may be positioned approximately 46.5 mm to 48.5 mm from the first contact surface 72. The side adjacent first contact surface 72 may be positioned approximately 47.5 mm from the first contact surface 72. A side of the boss 66 may be positioned approximately 46.5 mm to 48.5 mm from the second contact surface 74. The side adjacent second contact surface 74 may be positioned approximately 47.5 mm from the second contact surface 74.

Figure 8:
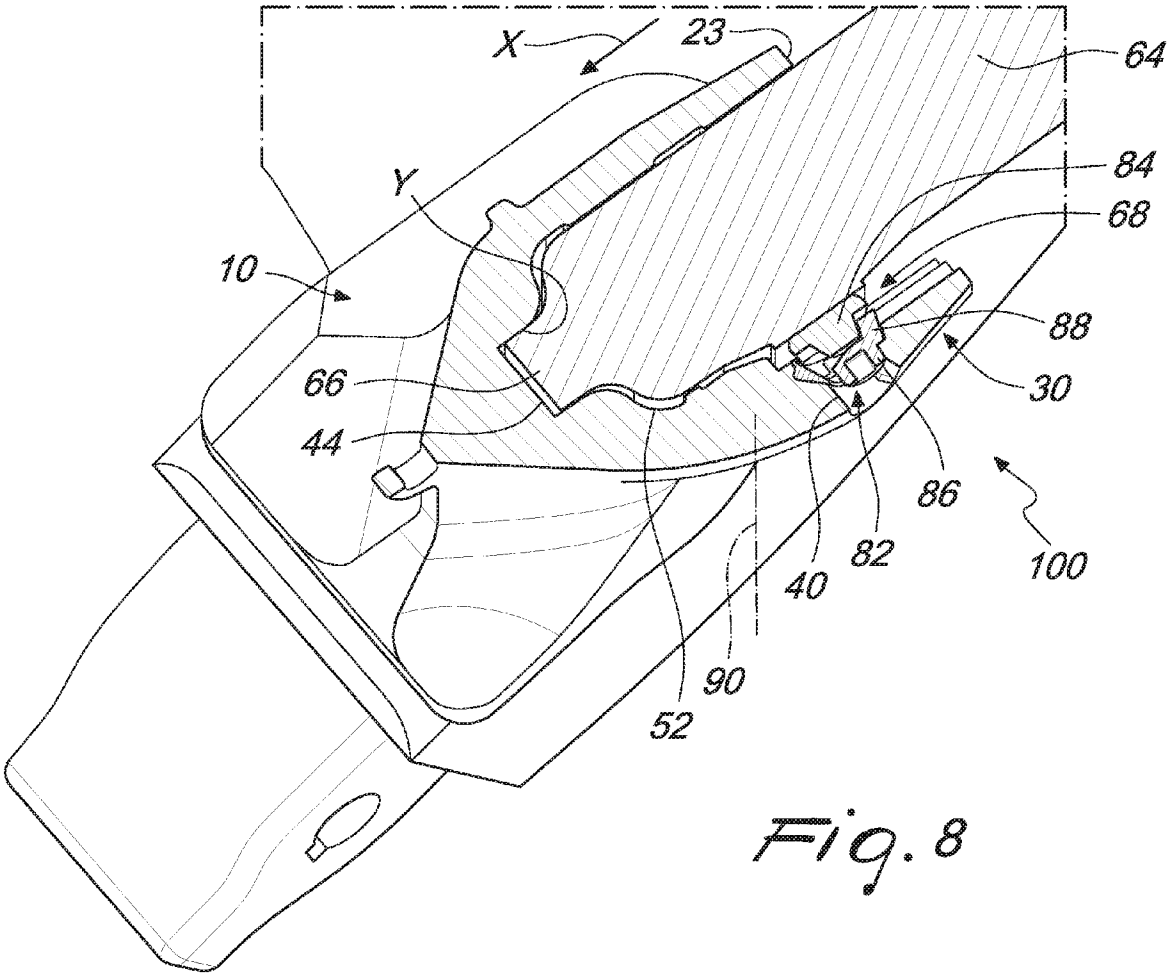
FIG. 8 is a transverse sectional view of the wing shroud of FIG. 1 mounted on the structural element of FIG. 6.

FIG. 8 illustrates a transverse section of a dragline lip assembly 100 with a wing shroud 10 mounted on a respective upright member 64. The upright member 64 may be engaged in the channel 52. Lock assembly 68 may be coupled to the securing portion 30.

Lock assembly 68 may comprise a lock element 82 and a lock weldment 84. The lock element 82 may be inserted into the wing shroud 10 within the void 31 of the securing portion 30. Lock weldment 84 may be welded to the upright member 64.

The lock element 82 may have a first abutment portion 86 and a second abutment portion 88. First lock element 82 may rotatably interact with the securing portion 30. First abutment portion 86 may be rotatably held in the aperture 40. Second abutment portion 88 may abut with the lock weldment 86. In an embodiment, the lock element 82 may be installed in the wing shroud 10 to couple to the lock weldment 84 provided on the dragline lip 62.

In a lock position of the lock element 82, the second abutment portion 88 may abut a side of the lock weldment 84 the side furthest from the opening 44 and the boss 66. With the lock element 82 in the lock position, the lock assembly 68 may be interposed between the upright member 64 and the wing shroud 10 to lock translational motion between upright member 64 and the wing shroud 10.

Figure 9:
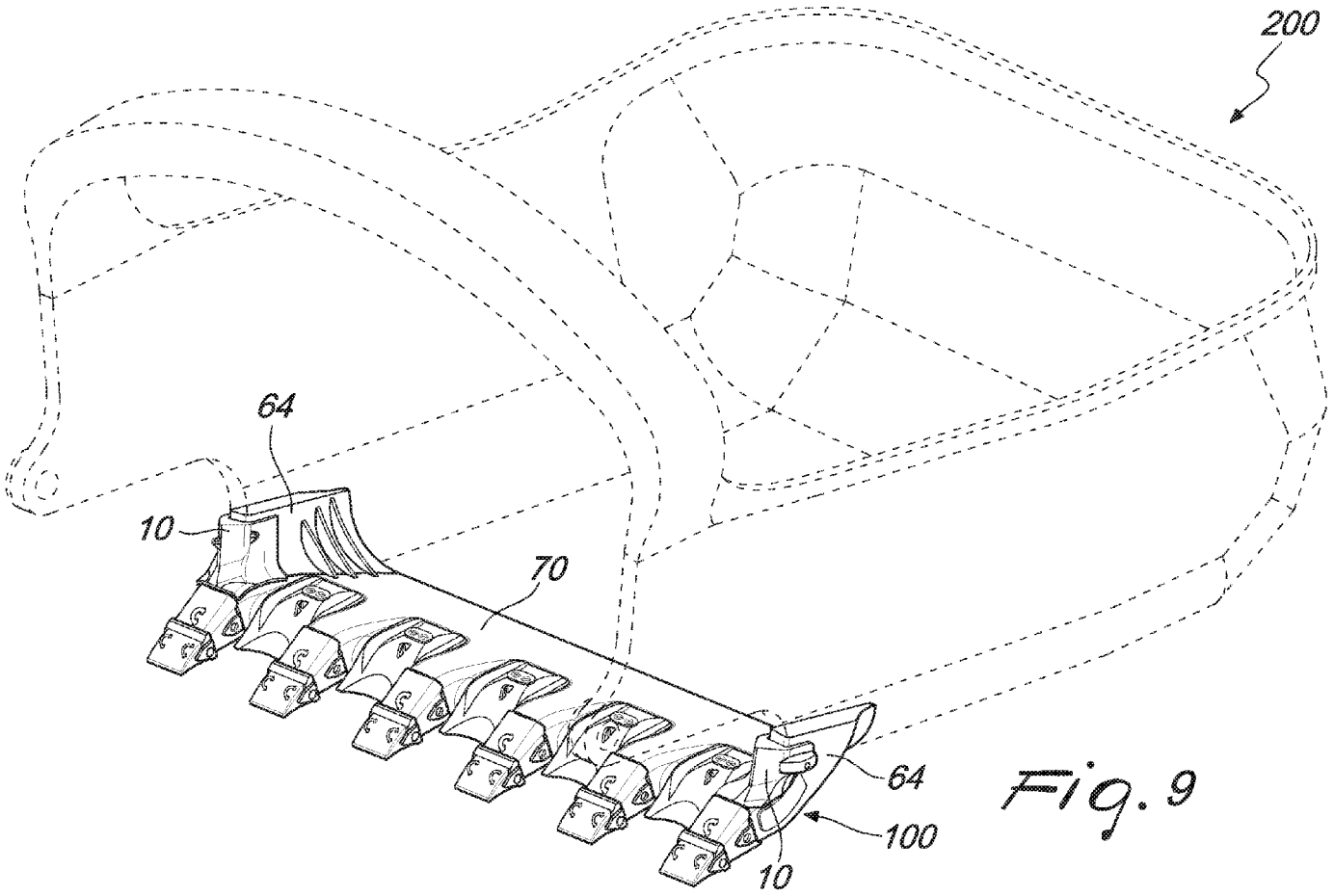
FIG. 9 is an isometric view of a dragline bucket with the bucket lip having wing shrouds mounted thereon.

FIG. 9 illustrates a dragline bucket 200 provided with the dragline lip assembly 100. The dragline lip assembly 100 may have the wing shrouds 10 mounted to the respective upright members 64.

The skilled person would appreciate that foregoing embodiments may be modified or combined to obtain the wing shroud 10 of the present disclosure.

INDUSTRIAL APPLICABILITY

This disclosure describes a wear shroud 10 as a replaceable wear part for a ground engaging implement such as an excavator bucket or a dragline bucket. The wing shroud 10 may be mounted to bucket. The wing shroud 10 may be mounted to the corresponding structural element of the bucket. Wing shroud 10 may shield the structural element of the bucket from wear during operations such as mining and earth moving operations. Wing shroud 10 may be made of wear materials suitable for the mining and earth moving operations.

Wing shroud 10 may be easily and efficiently mounted on and dismounted from the bucket. Once the wing shroud 10 is consumed during mining and earth moving operations, the wing shroud 10 may be easily replaced with another wing shroud 10.

The mounted wing shroud 10 may be subjected to forces that may result in the decoupling of thereof during the mining and earth moving operations. During discharge of material contained in a bucket, the wing shroud 10 may be subjected to forces as the load leaves the bucket. Mounted wing shroud 10 may be subjected to forces that tend to effect a rotation thereof relative to the structural element of the bucket. The mounted wing shroud 10 may be subjected to forces that tend to rotate the wing shroud 10 about a rotational axis that may be substantially parallel to the longitudinal axis of the wing shroud 10. In an embodiment, the rotational axis may correspond to the longitudinal axis of the wing shroud 10.

The coupling of the lock assembly 68 at the securing portion 30 enables the wing shroud to be maintained on the upright portion 64 in the absence of work operations and during mining and earth mining operations when the material is loaded into the bucket. Structural damage and/or premature wear to the wing shroud 10 and/or the locking assembly 68 may be prevented. Wing shroud 10 may avoid being decoupled from the bucket through the interaction of the opening 44 and the boss 66. The interaction between the lock assembly 68 and the securing portion 30 may be provided with greater play relative to the interaction between the opening 44 and the boss 66.

With respect to FIG. 8, as loaded material is discharged force X may act on the first free edge 23 of the first sidewall 14. The force X may tend to push the first sidewall 14 away from the bucket. As the wing shroud 10 is mounted around the structural element of the bucket on three contiguous surfaces where each adjacent surface is substantially orthogonally positioned, the force X may push the wing shroud 10 rotationally about a rotational axis 90. The interaction of the boss 66 in the opening 44 at point Y may prevent the rotational forces from being transferred to the lock assembly 68 and the securing portion 30.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein.

Where technical features mentioned in any claim are followed by reference signs, the reference signs have been included for the sole purpose of increasing the intelligibility of the claims and accordingly, neither the reference signs nor their absence have any limiting effect on the technical features as described above or on the scope of any claim elements.

One skilled in the art will realise the disclosure may be embodied in other specific forms without departing from the disclosure or essential characteristics thereof. The foregoing embodiments are therefore to be considered in all respects illustrative rather than limiting of the disclosure described herein. Scope of the invention is thus indicated by the appended claims, rather than the foregoing description, and all changes that come within the meaning and range of equivalence of the claims are therefore intended to be embraced therein.

The disclosures in European Patent Application No. 14157320.4 from which this application claims priority are incorporated herein by reference.

The invention claimed is:

1. A dragline lip assembly comprising:

a dragline lip comprising at least one upright member having a boss; and a wing shroud comprising:

a first sidewall having a first abutment surface;

a second sidewall having a second abutment surface wherein the second sidewall has a securing portion configured so as to be coupled to a lock assembly on the dragline lip; and a centre wall having a third abutment surface provided with an opening, the centre wall connecting the first sidewall and the second sidewall wherein the first, second and third abutment surfaces define a channel to receive a portion of the at least one upright member and wherein the boss is insertable in the opening.

2. The dragline lip assembly of claim 1 wherein the at least one upright member further comprises a first contact surface and a second contact surface having a lock assembly wherein the first and second contact surfaces are substantially parallel.

3. The dragline lip assembly of claim 2 wherein a plane transversally intersecting the boss is substantially normal to the first contact surface.

4. The dragline lip assembly of claim 2, wherein the at least one upright member further comprises a third contact surface connecting the first contact surface to the second contact surface, the third contact surface being substantially normal to the first contact surface.

5. The dragline lip assembly of claim 4 wherein the boss is provided on the third contact surface.

6. The dragline lip assembly of claim 5 wherein the boss is centrally aligned on the third contact surface.

7. The dragline lip assembly of claim 4 wherein the first contact surface is substantially orthogonal to the third contact surface.

8. The dragline lip assembly of claim 5, wherein the first contact surface is substantially orthogonal to the third contact surface.

9. The dragline lip assembly of claim 6, wherein the first contact surface is substantially orthogonal to the third contact surface.

10. The dragline lip assembly of claim 3, wherein the at least one upright member further comprises a third contact surface connecting the first contact surface to the second contact surface, the third contact surface being substantially normal to the first contact surface.

11. The dragline lip assembly of claim 1, wherein the channel of the wing shroud has a substantially U shaped cross section.

12. The dragline lip assembly of claim 1, wherein the securing portion of the second sidewall has an aperture.

* * * * *